United States Patent [19]

Monzie et al.

[11] 4,126,656

[45] Nov. 21, 1978

[54] METHOD FOR MANUFACTURING FILAMENTS OF VISCOSE

[75] Inventors: Pierre Monzie, Grenoble; Serge Chaunis, Saint-Ismier; Pierre Goullioud, Ecully; Patrick Lainé, Collonges-au-Mont-D'Or, all of France

[73] Assignee: Centre Technique de L'Industrie des Papiers, Cartons et Celluloses et Technique Papetiere Avancee, Grenoble, France

[21] Appl. No.: 794,584

[22] Filed: May 6, 1977

[30] Foreign Application Priority Data

May 7, 1976 [FR] France ..... 76 14350
Jan. 13, 1977 [FR] France ..... 77 01632

[51] Int. Cl.[2] ..... C04B 15/14; D01F 2/06

[52] U.S. Cl. ..... 264/83; 264/188; 264/207

[58] Field of Search ..... 264/83, 82, 199, 188, 264/143, 207

[56] References Cited

U.S. PATENT DOCUMENTS

| | | | |
|---|---|---|---|
| 1,357,206 | 10/1920 | Fuller | 264/83 |
| 1,881,742 | 11/1932 | Lilienfield | 264/83 |
| 1,979,403 | 11/1934 | Ostermann | 264/83 |
| 2,284,028 | 5/1942 | Ubbelohde | 264/143 |
| 3,833,438 | 9/1974 | Kaneko et al. | 264/199 |
| 3,888,771 | 6/1975 | Isuge et al. | 264/199 |

FOREIGN PATENT DOCUMENTS

| | | | |
|---|---|---|---|
| 321,679 | 11/1929 | United Kingdom | 264/199 |

*Primary Examiner*—Jay H. Woo
*Attorney, Agent, or Firm*—Arnold, White & Durkee

[57] ABSTRACT

A method for manufacturing viscose filaments from a cellulosic starting material wherein a viscose is prepared from the cellulosic starting material, the viscose is extruded by passing it through a spinneret to form continuous thin strands, the extruded strands are passed continuously through a gaseous medium which contains at least one volatile agent of such a nature, and under such conditions, that a coagulating action on the said strands results, the strands which have thus been coagulated are then brought into contact with an acid medium which causes a pre-regeneration of the initial cellulose, so that the strands are converted to continuous filaments, and the filaments are passed through at least one other acide liquid medium which causes ultimate regeneration of the cellulose.

8 Claims, 4 Drawing Figures

METHOD FOR MANUFACTURING FILAMENTS OF VISCOSE

Figure 1:
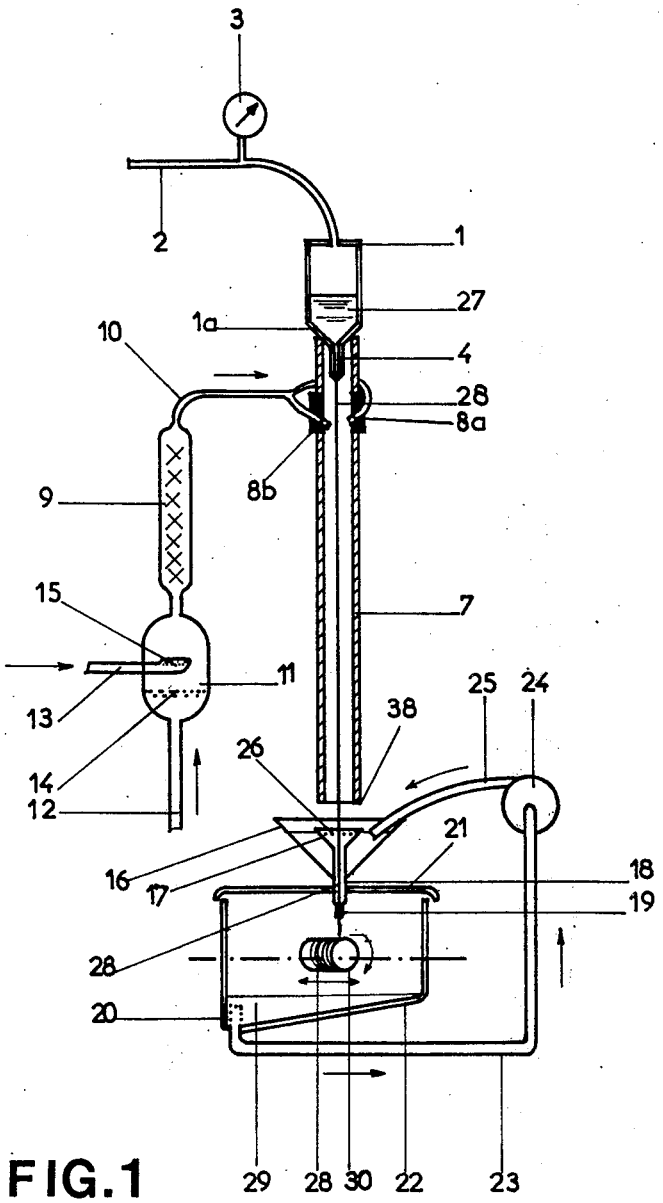

This invention relates to a method for the manufacture of filaments of viscose. The invention also relates to such filaments. Such filaments can be assembled to form yarns or tows intended to be converted into discontinuous fibres, or so as to acquire any other form of presentation (nonwoven materials, flocs and the like), for the purpose of their conversion to semi-finished or finished articles.

The manufacture, on an industrial scale, of continuous filaments of conventional viscose has, for some years, involved essentially spinning a solution of cellulose xanthate in dilute sodium hydroxide solution (a so-called viscose solution) in a sulphuric acid bath. The xanthate is decomposed, so as to regenerate the initial cellulose, the cellulose which has undergone this transformation becomes insoluble in the coagulant medium and acquires the form of filaments, in the said medium, because of the viscose solution having been fed into the bath in thin strands.

For its satisfactory execution, this process usually involves, as cellulosic starting materials, wood pulps with a high content, at least 90%, of alpha-celluloses (parts of matter insoluble in sodium hydroxide solutions at 17% by weight).

Using such cellulosic starting materials, numerous operations have to be carried out, in particular, in sequence: steeping the starting material in a sodium hydroxide solution so as to give alkali cellulose, removing the excess sodium hydroxide and soluble celluloses from the alkaline solution, mechanically dividing and ripening the alkali cellulose, sulphurisation with carbon disulphide to convert the alkali cellulose into cellulose xanthate, dissolution of the latter substance in dilute sodium hydroxide solution to give the actual crude viscose, careful filtration steps, ripening of the composition and removal of bubbles therefrom and finally, spinning the composition through spinnerets immersed in a coagulant bath. The bath most commonly comprises a fixed acid (e.g. sulphuric acid), a sodium salt (e.g. neutral sodium sulphate) and an auxiliary salt (e.g. zinc sulphate). This stage of the process neutralises the sodium hydroxide, decomposes the xanthate, regenerates the cellulose and coagulates the new polymer formed to give filaments which are then removed from the bath, wound up, washed, dried, sorted and so on.

At present, this sequence of operations requires starting materials of high quality in order to reduce contamination of the substances subsequently formed or disturbance of the working stages. Nevertheless, it proves necessary, at the end of the operations preceding the spinning, to carry out repeated filtrations of the viscose mass so as to remove foreign matter and gels or other insoluble particles which may still be present therein.

French Patent No. 898,802 describes a process of dry spinning in solvents of high boiling point, which involves the use of a spinning chamber through which a stream of high temperature air flows downwards, and in which the zone located near the spinneret is heated to a temperature of about 600° C. This process is very expensive because it requires a considerable heat input and special equipment, while the filaments obtained do not exhibit the properties currently required for conventional textile uses, especially because of the sudden coagulation on issue from the spinneret.

According to the present invention there is provided a method of manufacturing viscose filaments from a cellulosic starting material wherein a viscose is prepared from the cellulosic starting material, the viscose is extruded by passing it through a spinneret to form continuous thin strands, the extruded strands are passed continuously through a gaseous medium which contains at least one volatile agent of such a nature, and under such conditions, that a coagulating action on the said strands results, the strands which have thus been coagulated are then immediately brought into contact with an acid medium which causes a pre-regeneration of the initial cellulose so that the strands are converted to continuous filaments, and the filaments are passed through at least one other acid liquid medium which causes ultimate regeneration of the cellulose.

The present invention makes it possible to manufacture continuous filaments of viscose, having properties substantially equivalent to those of the conventional filaments currently produced, and to do so whilst employing, as starting materials, cellulosic pulps of any origin and in particular, if desired, cellulosic pulps less rich in alpha-cellulose than those previously, and to do this whilst dispensing or at least reducing the repeated operations of filtering the viscose mass before it is spun. These points obviously allow a decrease in the cost of making viscose filaments.

In order to carry out the process according to the invention, the usual steps involved in the preparation of viscose may be used, except that when pulps rich in alpha-celluloses are employed it may be possible to dispense with the repeated final filtrations and to manage with a succinct filtration. However it is also possible, as will be seen in greater detail below to start from cellulosic pulps with alpha-cellulose contents substantially less than 90% by weight, and especially "paper-making" pulps such as the so-called "bleached kraft" pulps or bleached sulphite pulps.

It may be mentioned that an important factor for successfully carring out the process according to the invention is the state of ripening of the initial viscose. It is necessary to use viscose of which the state of ripeness is as close as possible to the gelling point, without however the viscose being gelled. The desirable degree of ripening can be obtained by varying the duration and/or the temperature of ripening and/or by employing known chemical agents, for example formaldehyde. It is possible with the invention, to spin viscoses which have very high viscosities which it would not be possible to spin by the known processes.

For spinning the viscose, in the method of the invention, it is possible to use flat or hollow, non-immersed spinnerets, because the material is initially spun "dry," that is to say it is not extruded directly into a liquid bath, but into a gaseous medium. Of course, a suitable pressure is exerted on the mass of viscose to be spun, in order to bring about and maintain the extrusion process, for example a pressure exerted by an inert gas.

In the step of passing the freshly extruded strands through a gaseous medium containing at least one volatile agent, it has been found that various volatile agents give valuable results. These agents can be organic, as for example methanol and acetone, which themselves exert a coagulating action on the strands of viscose, that is to say they impart to the filaments a physical structure which makes it possible to draw them more strongly, although this structure remains reversible. The volatile agents can also be inorganic.

The character of these agents plays a role in the properties of the filaments, and it is acid agents which have proved the most active. By themselves, these acid agents initiate an effect of pre-regeneration of the cellulose from its xanthate anyway. In the situation of the present invention they liberate, from the sodium salt of the cellulose xanthate, the sodium salt of the acid used (for example sodium chloride if hydrochloric acid is chosen), and this salt exerts a coagulating effect on the strands of viscose. Such acid agents include, inter alia, carbon dioxide, formic acid, acetic acid and particularly hydrochloric acid. The pre-regeneration effect can be strengthened by for example, substantially increasing the amount of volatile acid agent.

The gaseous medium through which the freshly extruded strands are passed, advantageously contains other gases such as air, but it could equally well contain a single inert gas, such as nitrogen, in addition to the coagulating agent.

The freshly extruded strands of viscose can be caused to enter directly into the gaseous medium charged with a coagulating agent. Preferably, however, the strands are caused initially to travel a distance in an inert gaseous atmosphere (for example air) before being subjected to the gaseous medium containing the volatile coagulating agent.

In British Patent No. 321,679 it was proposed to coagulate extruded strands by means of a gaseous and volatile acid medium, for example containing hydrochloric acid or sulphuric acid. The action of the gaseous acid was exerted rapidly, and had to be interrupted abruptly, as the coagulation stage and the ultimate regeneration stage were carried out simultaneously and immediately, so that the filaments obtained had a definitive structure and were difficult to draw. The fact that the cellulose is coagulated and regenerated abruptly is unfavourable as far as the homogeneity of the filaments is concerned, because these conditions favour a superficial regeneration. In contrast, with this invention, a first coagulation stage, followed by a pre-regeneration stage and terminated by the ultimate regeneration stage are carried out successively and without interruption. This makes it possible easily to draw the filaments and to impart excellent textile properties to them.

In any case, after having passed through the gaseous medium containing the volatile coagulating agent, the strands of viscose which have been coagulated in this way are brought immediately into contact with at least one acid liquid medium which ensures the regeneration of the cellulose from the xanthate.

In order to carry out this last operation, it is advantageous to bring the strands of viscose which leave the gaseous medium containing the coagulating agent into contact initially with a first liquid which subjects the strands to a guiding and driving action. Preferably, this medium is chosen so as to have an acid character, for example by adding sulphuric acid, so as to cause the medium to exert on the strands of viscose a pre-regeneration of the cellulose, from the xanthate constituent. Simultaneously the strands can be subjected to a mechanical drawing, for example by a winding-up action, which is superposed on the gravitational drawing which the strands undergo on leaving the spinneret, if, as is preferred, the spinning is carried out vertically downwards. Thereafter, the ultimate regeneration of the xanthate is completed in another acid liquid medium.

The object of the "coagulation" operation is to impart to the strands of viscose a physical structure which allows them to be drawn more forcefully but which nevertheless remains reversible.

The operation consists of precipitating the cellulose xanthate from the initial solution, without decomposing it. Thus, the coagulated strands can be forcefully drawn but cannot be worked as such. Their physical structure remains reversible.

The "regeneration" operation consists of decomposing the cellulose xanthate of the coagulated filaments into cellulose and $CS_2$. The regenerated filament contains virtually no more cellulose xanthate and its structure is definitively fixed.

In this description, the term "pre-regeneration" is applied to a gentle and very gradual start of regeneration, sufficient to render the filament workable as it is, but nevertheless leaving the filaments with a substantial drawability. This pre-regeneration operation, which immediately follows the coagulation can be carried out in a flexible manner adapted to the desired properties (especially the draw ratio) of the regenerated viscose filaments to be obtained at the end of the process. In effect, as has been stated above, if an acid is chosen as the volatile coagulant, the acid initiates the pre-regeneration as from the coagulation stage and it is possible, depending on the draw ratio needed for the fineness of the desired filaments, to carry out this pre-regeneration very gradually in contact with a first acid liquid medium or to carry it out more rapidly by suitably increasing the feed of acid into the gaseous medium.

The pre-regenerated filament still contains a varying but relatively large proportion of cellulose xanthate, but the physical structure of the filament has now become irreversible.

The ultimate regeneration completes the decomposition of the residual xanthate in the pre-regenerated filaments and it is carried out in accordance with the chemical state of the filaments on leaving the pre-regeneration stage.

Proceeding in a way as described above, it has surprisingly been found possible to spin filaments through markedly larger orifices than was the case hitherto, for example through orifices of diameter (or largest dimension) from 500 to 1000 microns instead of the 60 to 100 micron orifices previously used, that is to say orifices from 5 to 15 times larger. It is possible, to achieve, using sodium cellulose-xanthate solutions which have only undergone one succinct filtration, practically similar results as regards the fineness of filaments (1 to 7 deniers) and dry state breaking loads of the same order of magnitude for these filaments (1 to 2.5 grams/denier) as with commercial viscose rayon filaments, as with eliminating the need to carry out repeated filtration processes, which have hitherto been considered as absolutely essential in the viscose industry.

This fact and the large diameters of the spinning orifices, allow use of lower quality thresholds of the cellulosic pulp starting material and to use pulps less rich in alpha-celluloses than hitherto, and especially so-called "papermaking" pulps.

Viscose filaments obtained by the process according to the invention have a different structure, both on the microscopic scale and on the molecular scale, of the structure of the filaments, obtained by conventional methods, and exhibit different behaviour, at least towards certain reactants.

Filaments manufactured by the method of the present invention have characteristics which allow them to be distinguished from known filaments, and exhibit the following features:

1. Little or no morphological difference between the periphery and the core of the filaments is observed under polarised light, by phase contrast, by examination with a scanning electron microscope, or by staining sections with Victoria Blue (the sample being embedded in methacrylate), and the material constituting the new filaments thus appears to be particularly homogeneous.

2. Little or no difference in the degree of orientation of the cellulosic macromolecules has been detectable on examination by electron diffraction, either on longitudinal sections or on transverse sections; this degree of orientation is medium throughout the filament, in contrast to the conventional filaments which can be either more or less oriented or be highly oriented throughout their length.

3. A characteristic behaviour towards the dyestuff called "Brilliant Dyestuff Blue FF Ciba" of the new filaments is observed. In fact, staining takes place, during a first stage, in the peripheral zone of the filament whilst thereafter, in a second stage, it reaches the central part so as to give a very intense coloration through the whole fibre.

4. Finally, an excellent ability of the new filaments to swell in water and in sodium hydroxide solution, with a difference in degree of swelling between an internal zone and an external zone, has been noted.

The new filaments can be prepared in the same forms as the usual viscose filaments, for instance as continuous filaments (rayon), as discontinuous staple fibres as tows, slivers, threads, double yarns, wadding, flock, and non-wovens.

The filaments thus obtained by the method of the invention can be subjected to the treatments usual in the rayon and staple conversion industry, in particular mechanical treatments essentially having the object of changing the presentation of the said filaments, for example by cutting tows of filaments so as to obtain loose fibres, winding up the yarns on bobbins, beams, cones or other suitable supports, or "unsupported" storage by depositing the material in movable containers.

It has been found that it is not necessary to carry out every one of the operations in the method of the invention before carrying out various treatments, especially the mechanical treatments mentioned above and hereafter referred to under the general term of "working treatments", to which finished viscose filaments are usually subjected. In fact, it has been observed that the strands of viscose obtained during the method of the invention can be subjected to working treatments as soon as they issue from the gaseous medium containing the volatile agent which has a coagulating action or at the end of the pre-regeneration operation. From this moment onwards, in effect, the strands are in a sufficiently individualised, viscous and strong state, devoid of adhesive characteristics, to be worked in accordance with the usual working methods employed on finished filaments. This observation is of importance because it makes it possible soon after extrusion, to change the presentation of the filaments and to subject them to the working treatments under different conditions from before, which can give greater simplicity and greater efficiency. If, for example, after passage through the gaseous coagulating medium and also, perhaps through the liquid pre-regenerating medium, the freshly spun strands are cut a loose fibrous material is collected and it is possible to carry out the ultimate regeneration on such fibrous material by the usual operations of steeping, washing, desulphurising, rinsing and drying under much more favourable conditions than hitherto. This is because the fibrous material, being in a divided state, can be more intensely and rapidly subjected to the action of the subsequent media, such as liquid media containing a fixed acid, aqueous media and air than was the case previously, when the material was in a more or less compact state.

In U.S. Pat. No. 2,284,028, it has already been proposed to obtain strands of viscose, before complete regeneration of the cellulose, which can be converted by direct working, by cutting into discontinuous fibres, by winding-up, by crimping or by curling of the filaments. However, the process taught comprises a dry spinning stage at a temperature above 100° C. in a gas atmosphere intended to cause genuine drying of the extruded strands. Accordingly, these conditions are completely different from those in the method of the invention, which is usually carried out at ambient temperature or at a temperature very slightly different therefrom, and without in any way seeking a drying effect and which, on the contrary, is carried out in the presence of a volatile agent having a coagulating effect. Furthermore, if such an agent has an acid character, the coagulation which it causes on the freshly extruded viscose strands is accompanied, with an initiation of pre-regeneration of the cellulose which facilitates the working treatment and simplifies or shortens subsequent regeneration treatments.

The selection of the stage at which to carry out working treatments on the not entirely regenerated viscose strands, for instance at the end of the spinning in a gaseous medium or later depends on many factors such as the nature and proportion of the coagulating agent in the gaseous medium, the spinning speed and pressure, the temperature and degree of ripening of the viscose prior to extrusion, the temperature of the gaseous medium and, where relevant, of the acid liquid medium, and the type and nature of the working treatment to which the freshly spun strands are to be subjected. It is therefore difficult to give firm recommendations, since the factors in question are so numerous and variable but, with given working conditions it will be possible, easily to decide when to apply the working treatment. The main factors will be the strength, the viscosity and the absence of adhesion between the strands.

The strands collected after the operations of passing through the gaseous coagulant medium or more particularly, a liquid pre-regenerating medium, exhibit good individualisation and sufficient viscosity and sufficient strength to enable them to be worked satisfactorily and efficiently. It has been observed that from these times onwards these strands have a substantially circular cross-section and that they retain this cross-section during subsequent working treatments and up to the end of the operations which lead to the ultimate regeneration of the cellulose. Usually, known finished viscose filaments show a dentate cross-section and hitherto only the synthetic filaments which were melt-spun had a circular cross-section.

Also, strands collected after passing through the gaseous medium possess a certain plasticity under ambient conditions, that is to say a capacity to under-go permanent deformation under the effect of certain mechanical stresses.

This property renders the strands malleable and mouldable, in other words they are capable of being shaped by moderate external forces. This is an obvious advantage when the strands are subjected to a working treatment. The deformation imparted to the strands (flattening, constrictions, cuts or crimp) are preserved during the finishing (regenerating) operations and thus appear in the final product.

Amongst the working treatments which the incompletely regenerated viscose strands can undergo there may be mentioned, cutting a tow of strands to form a loose fibrous material, which material can then be subjected to the various operations of crimping, sorting, dyeing, washing, drying and realignment to give threads and the like. After the operations leading to the ultimate regeneration of the cellulose, fibres of the cotton, wool, papermaking or flock type, non-wovens, fibres for wadding, padding, insulating, filtration and the like, can be obtained.

Amongst the other working operations there may be mentioned spooling, winding-up, unwinding and storage.

The products obtained can be used where there is a need for fibrous materials, either pure or mixed with other fibres, in particular for the manufacture of textile articles for domestic, furnishing or industrial purposes, for use in papermaking, for the construction of articles based on non-wovens, and for the production of laminated materials, in particular in association with various resins or plastics.

The invention also provides a method of manufacturing viscose filaments from a prepared viscose wherein the viscose is extruded by passing it through a spinneret to form continuous thin strands, the strands are passed continuously through a gaseous medium which contains at least one volatile agent of such a nature, and under such conditions, that a coagulating action on the strands results, the thus coagulated strands are then brought into contact with an acid medium which causes a pre-regeneration of the initial cellulose from which the viscose was prepared, so that the strands are converted to continuous filaments, and the filaments are passed through at least one other acid liquid medium which causes ultimate regeneration of the cellulose.

In another aspect the invention provides apparatus for manufacturing viscose filaments from a viscose prepared from cellulosic pulp, such apparatus including a vertical extrusion-spinning installation including a vessel to be fed continuously with viscose with, below the vessel a spinneret with one or more orifices through which the viscose can be extruded, and means to exert pressure on the viscose, an elongate chamber located below the spinneret, means to introduce a gaseous coagulant medium into the said elongate chamber, means to contain a medium for causing ultimate regeneration of the cellulose from its xanthate, and means to feed the strands therethrough.

The extrusion-spinning installation advantageously also comprises, vertically below the spinneret, a device constructed so as to ensure the continuous circulation of a liquid, in a downward direction, over at least a part of its surface.

Figure 2:
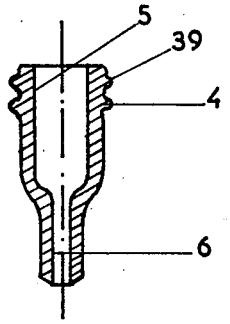
Figure 3:
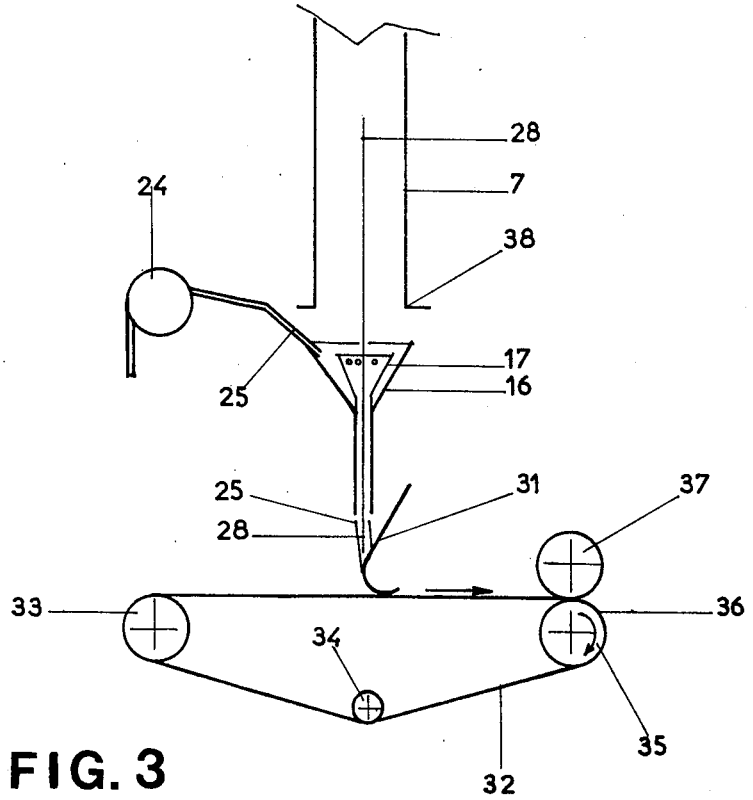
Figure 4:
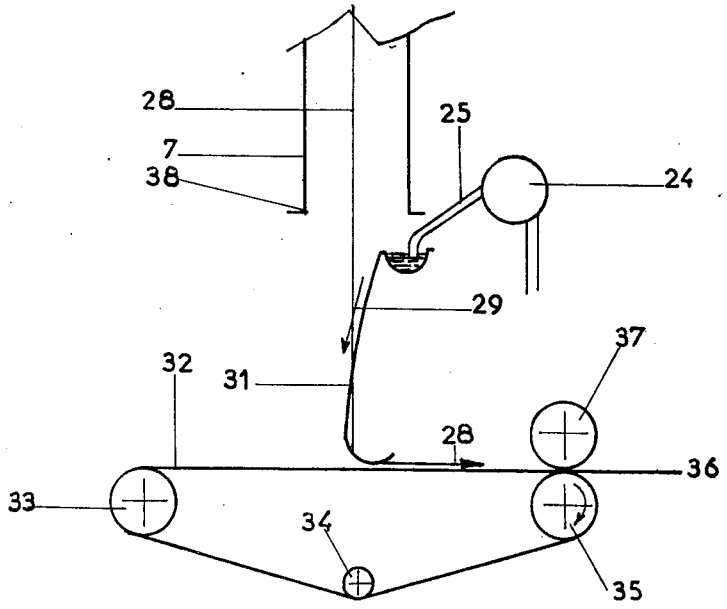

The invention will be more clearly understood from the following description which is given by way of example only, with reference to the accompanying drawings, in which:

FIG. 1 schematically represents an extrusion-spinning apparatus according to the invention;

FIG. 2 shows, in cross-section, a spinneret used in the said apparatus;

FIGS. 3 and 4 schematically illustrate two other embodiments of the system of receiving the pre-regenerated coagulated filaments.

No particular description or illustration of the means used to prepare viscose from the cellulosic pulp need be given since such is well known.

The Figures show apparatus to be located downstream of such means for preparing viscose. Such apparatus essentially comprises a vertical cylindrical reservoir 1 which is fed continuously with viscose. The viscose, under the effect of a nitrogen pressure exerted by means of an inlet tube 2 provided with a manometer 3, is extruded through the orifice of a spinneret 4 connected to the small end of the truncated-cone shaped bottom part 1*a* of the reservoir 1. The spinneret 4 (see FIG. 2) is advantageously made of glass though it could be stainless steel or any other appropriate metal, or even plastics, and consists of a cylindrical nozzle 5 merging into a capillary tube 6, the diameter of which is 600 microns. In the example illustrated, this spinneret is screwed onto the bottom of the reservoir 1 by means of a screw thread 39.

A cylindrical column 7 having an internal diameter of 7.5 cm and a length of 125 cm, is located on the truncated-cone bottom part 1*a* of the reservoir 1, and is axially aligned therewith.

At a distance of about 25 cms from the top of the column 7, there opens, into the column, at diametrically opposed points 8*a* and 8*b*, an inlet for a gaseous mixture fed, via a homogeniser 9 and a tube 10, from a source 11. The source 11 receives compressed air via a pipeline 12 and hydrogen chloride gas through a pipeline 13. At 14 and 15 are shown sintered glass distributing devices which ensure good distribution of the mixture.

The base 38 of the column 7 is just above a funnel comprising two coaxial concentric bodies 16 and 17 joined at a point 18 and aligned axially with the column 7, the body 17 extending below the point 18 to a constriction 19 at which it opens into a tank 20 having a cover 21 and an inclined bottom 22. At the lower point of this bottom 22 is a tube 23 connected to a pump 24 which, via another tube 25, can pass ;iquid 29 contained in the bottom of the tank 20 into the truncated-cone annulus which exists between two truncated conical parts of bodies 16 and 17. By suitably regulating the flow rate, a part of the liquid continuously remains between the two truncated conical parts and passes into the inner conical part through orifices 26 formed on its walls at the same horizontal level, and spreads as a thin layer over the inner truncated cone surface of the body 17 until it fills the construction 19.

Vertically below the combination of reservoir 1, column 7, funnel 16 and 17, point 18 and constriction 19, and in the tank 20, is located a wind-up cylinder 30 which is rotatable about a horizontal axis and can be subjected to a slow reciprocating movement along this axis, by means of conventional control device. The cylinder 30 is so arranged that a plane tangential to it includes the axis of the funnels 16 and 17 and of the point 18, so that a filament 28 which has issued vertically from the constriction 19 engages tangentially with the turns of the coil which it forms on the cylinder 30. In use, the cylinder 30 is sprinkled with the liquid 29 from the constriction 19. The liquid 29 is cycled in a closed circuit through these devices.

In the course of the cycle, the content of reagents in the liquid medium can be controlled and continuously adjusted.

The filaments 28 will be subjected to a final treatment with sulphuric acid, under conditions such that the ultimate regeneration of the cellulose from any xanthate not completely decomposed during the pre-regenerating operation takes place, and will also be subjected to various other treatments such as washing and desulphurisation.

In a modified embodiment (see FIG. 3), the filament 28 which has issued from the constriction 19 of the funnel falls onto a curved surface 31, for example made of sheet metal which forms an angle guide for the filament which then falls onto an endless belt 32 which is moved continuously by means of rollers 33, 34 and 35 of which at least one is driven. At the end 36 of this belt, the filament 28 is collected.

In another modification (FIG. 4), the filament 28 which has issued from the bottom 38 of the chamber 7 falls directly onto a similar curved surface 31 and from there onto an endless belt 32 where it is drawn off by a draw-off device 37 such as a driven roller.

These two modifications make it possible to integrate into the process, in a continuous manner, conventional finishing operations, such as regeneration, desulphurisation, washing and the like.

The method in which this apparatus can be used to obtain continuous filaments of viscose will now be described.

First of all, by way of example, there is described a method of preparation of a viscose from a bisulphite wood pulp, which is very suitable for conversion to filaments of regenerated cellulose.

The pulp possesses the following characteristics: degree of polymerisation (DP) calculated from intrinsic viscosity of the solution cadoxene with the aid of

| | |
|---|---|
| the JAYME equation) | 735 |
| content of alpha-cellulose | 90.3% |
| Mahood index (standard specification AFNOR-T-12,003) | 12% |
| brightness (measured on the Elrepho photometer, the reflection factor being 100% for MgO) | 92 |

In the preparation of the viscose, amounts of this pulp corresponding to 400 grams of alpha-celluloses, in the dry state, are subjected to the usual treatments involved in the preparation of viscose, under the conditions given below:

| | |
|---|---|
| Alkali cellulose | |
| Steeping in sodium hydroxide solution: | |
| sodium hydroxide (content of the solution) | 18% (215 g/l) |
| volume of the alkaline solution | 4,000 $cm^3$ |
| temperature | 45° C |
| duration | 2 hours |
| Pressing: | |
| ratio | 3 |
| ambient temperature | |
| Shredding (Kustner type DMR malaxator): | |
| ambient temperature | |
| duration | 20 minutes |
| Ripening: | |
| temperature | 34° C |
| duration | 10 hours |
| Dry sulphurisation: | |
| temperature | from 26 to 29° C |
| duration | 2 hours |
| $CS_2$ (weight of $CS_2$ relative to weight of cellulose) | 31% |

-continued

| | |
|---|---|
| Alkaline cellulose obtained | |
| cellulose content | 36.5% |
| total NaOH content | 14.8% |
| Viscose | |
| Dissolution: | |
| temperature | 10° C |
| duration | 4 hours |
| initial viscose: NaOH content | 7.6% |
| cellulose content | 8% |
| Ripening: | |
| temperature | 20° C |
| duration | 18 hours |
| Filtration: | |
| for checking the filtration index: through a nylon cambric and linter under 2 bars of nitrogen for spinning: through a nylon cambric | |
| Deaeration: as usual. | |
| Characteristics of the viscose to be spun: | |
| viscosity in poises at 20° C: $t_o$ ($t_o$ = viscosity at time zero, that is to say before ripening) | 80 |
| $t_{8d}$ ($t_{8d}$ = viscosity after 8 days ripening at 20° C) | 180 |
| total sulphur (by weight, measured by the SCHONIGER combustion technique) | 3.4% |
| xanthate sulphur: gamma number determined by the spectrophotometric method introduced by TREIBER and ELMGREN | 51 |
| Filtrability: filtration index (if $T_1$ is the time required to obtain a predetermined weight of $P_1$ of filtered viscose and if $P_2$ is the weight of viscose filtered in time $4T_1$, the filtration index is $100 \times \frac{P_2}{4P_1}$) | 92 |

The extrusion of such a viscose, coagulation and preregeneration are now described with reference to the apparatus already described.

Such a viscose, 27, located in the reservoir 1, is extruded, at ambient temperature, under the effect of nitrogen pressure at a speed of 1 to 4 cms/second, through the capillary 6 of the spinneret 4, in the form of an initial strand 28. This strand 28 passes down the column 7 firstly for a distance of 25 cms through air and then, for 100 cms through another gaseous medium consisting of air/hydrochloric acid (feed rate : HCl : 0.5 to 1 gram/hour—duration of travelling of the strand in the chamber 7: from from 1/10 to 1 second). During this travel, the strand undergoes stretching under the double action of gravity and the mechanical effect of the draw-off device. While in the region of the acid gaseous medium it coagulates, acquiring the consistency of a gel.

The acid liquid 29 which travels in a closed circuit below the spinning apparatus, continues the pre-regeneration of the cellulose of the strand when the latter comes into contact with it in the constriction 19, where it is seized and driven along axially to become a viscose filament 28, consisting of viscose in the nascent state.

This acid liquid 29 has the following composition (in grams per liter):

| | |
|---|---|
| sulphuric acid | 40 |
| neutral sodium sulphate | 60 |
| zinc sulphate | 1 |
| water | q.s.p. 1 litre |

To achieve ultimate regeneration, the filaments 28 are then subjected to various treatments which in particular ensure the complete regeneration of the cellulose and its definitive presentation. These various treatments, with their essential details, are as follows:

steeping: in a bath containing 60 g of sulphuric acid/l, at 50–60° C., for 10 minutes, washing: in softened water, at ambient temperature, for 5 minutes, at a pH increasing firstly from 4.5 to 6.5 and then to about 8, desulphurisation: in a bath containing 2 g/l of $Na_2CO_3$ and 10 g/l of $Na_2SO_3$, at 90–95° C., for 20 minutes, washing: in softened water, at ambient temperature, initially at pH 9.5 and then down to pH 8 or 7, and drying: in a ventilated oven at 105° C. for 5 to 8 hours.

The table which follows summarises the characteristics of viscose filaments obtained in four Examples, 1 to 4, by applying the method of the invention under different conditions using different cellulosic pulps used as starting materials, the variations in method being the spinning conditions and the feed rate of hydrochloric acid into the gaseous medium. For comparison, the corresponding figures for a normal industrial viscose rayon, the reference figures are given.

It can be seen from these Examples that the invention provides the advantages that cellulosic pulps can be used of a quality as low as papermaking quality, and a succinct overall filtration of the viscose before spinning is employed, while the spinning of these viscoses using spinnerets with large orifices is in no way accompanied by a deterioration of the quality of the filaments. It is even shown to be possible to obtain filaments (e.g. Examples 2 and 4) with dry breaking strengths higher and with lower elongations (in all Examples) than are obtained with the conventional viscose filaments (reference). It should finally be recalled that these filaments also swell in water and are very suitable for dyeing.

TABLE OF PROPERTIES OF VISCOSE FILAMENTS AS A FUNCTION OF THE NATURE OF THE CELLULOSIC PULPS AND OF THE SPINNING CONDITIONS

| | | Properties of the viscoses | | | |
|---|---|---|---|---|---|
| Example No. | Cellulosic pulp | NaOH % by weight | Cellulose % by weight | Viscosity poises | D.P. |
| 1 | Ray. | 5.6 | 9.00 | 140 | 320 |
| 2 | Ray. | 7.5 | 8.1 | 195 | 380 |
| 3 | BK. | 7.5 | 8.8 | 480 | 310 |
| 4 | BB. | 7.6 | 8.1 | 210 | 310 |
| Ref. | IR. | 5.6 | 8.0 | 70 | 300 |

| | Spinning conditions | | |
|---|---|---|---|
| Example No. | Nitrogen pressure bars | Feed rate of HCl into the gaseous medium grams/hr | Wind-up speed meters/minute |
| 1 | 3.40 | 1.0 | 400 |
| 2 | 3.25 | 1.5 | 345 |
| 3 | 4 | 1.5 | 380 |
| 4 | 3 | 0.6 | 480 |
| Ref. | 3 | 0.6 | 480 |

| | Properties of the filaments obtained | | | | |
|---|---|---|---|---|---|
| Example No. | Mean diameter μ | Gauge denier | Dry breaking load grams per filament | Dry Unit breaking load grams/denier | Dry elongation at break % |
| 1 | 20.2 | 5.60 | 7.95 | 1.41 | 6.3 |
| 2 | 20.0 | 4.25 | 9.70 | 2.28 | 8.4 |
| 3 | 21.15 | 5.1 | 9.48 | 1.84 | 11.95 |
| 4 | 15.5 | 2.5 | 6.1 | 2.44 | 4.73 |
| Ref. | 11.0 | 2.56 | 4.26 | 1.66 | 13.6 |

NOTES:
Ray.: rayon
BK.: bleached Kraft (papermaking)
BB.: bleached bisulphite (papermaking)
IR.: industrial rayon, comparison
D.P.: mean degree of polymerisation Further Examples are as follows:

EXAMPLE 5

The procedure of Example No. 3 is followed. On leaving the gaseous medium, the freshly extruded strands, which are well individualised and devoid of any tendancy to stick together, and which under ambient conditions have a strength of about 5 grams for a filament of a diameter about 80 microns, are collected in an intermediate container. The strands have a round cross-section and their content of xanthate sulphur is between 14 and 22 (gamma number).

The strands are then taken up again and caused to pass through a conventional staple cutter which cuts the strands into fragments from 3 to 10 mm long. The cutting takes place without difficulty and finally a fibrous mass is obtained, which is subjected to the usual operations to complete regeneration of the cellulose by washing, desulphurisation, rinsing and drying.

Finally, a viscose fibre which has a round, very uniform cross-section and which is in particular suitable for the papermaking industry is obtained.

EXAMPLE 6

The procedure of Example 5 is followed but here the freshly extruded strands are fed directly into a conventional staple cutter which converts the strands into discontinuous filaments having a length of about 120 to 130 mm, a strength of about 7 grams for a filament of 50 microns diameter, a round cross-section, a significant, plasticity, and a xanthate sulphur content of approximately between 14 and 22 (gama number). After the subsequent operations carried out as mentioned in Example 5, viscose staple which is particularly suitable for being worked together with wool is obtained.

EXAMPLE 7

The procedure of Example No. 4 is followed. At the outlet of the liquid pre-regeneration medium, the freshly spun strands, which are well individualised, devoid of any tendancy to stick together and have a strength of about 17 grams per filament of 30 microns diameter, are collected on a bobbin.

The filaments thus collected are subjected to the usual operations of complete regeneration of the cellulose, by washing, desulphurising, rinsing and drying.

Viscose filaments which have a round, very uniform cross-section and are very suitable for the customary textile uses are obtained.

We claim:

1. A method of manufacturing viscose cellulose regenerated filaments from a cellulosic starting material wherein a viscose is prepared from said starting material until a state of ripening close to its gelling point, the viscose in such a state is extruded by passing it through a spinneret to form continuous thin strands, the extruded thin strands are passed in a continuous way at first through an inert gaseous medium, but through a coagulating gaseous medium, then again the strands having thus been coagulated are brought into contact with an acid medium which causes a preregeneration of the initial cellulose converting the strands into continuous filaments, and said filaments are passed through at least one acid liquid medium which causes ultimate regeneration of the initial cellulose.

2. A method as claimed in claim 1, wherein the coagulating gaseous medium contains a volatile agent of acid character reacting with the cellulose xanthate of the fresly extruded strands to produce a third substance which coagulates said strands, whilst gradually initiating a cellulose preregenerating effect on the strands.

3. A method as claimed in claim 2, wherein the volatile agent is hydrochloric acid and the third substance is sodium chloride.

4. A method as claimed in claim 1, wherein the time during which the freshly extruded strands pass through the gaseous media is between 0.1 and 1 second.

5. A method as claimed in claim 1, wherein the extrusion and the uninterrupted travel through the gaseous media and the preregeneration acid medium takes place substantially vertically downwards.

6. A method as claimed in claim 1, wherein the strands having passed through the gaseous media and before having been brought into contact with the ultimate regeneration acid liquid medium are subjected to at least one working treatment.

7. A method as claimed in claim 6, wherein a working treatment is applied on the strands having passed only through the gaseous media.

8. A method as claimed in claim 1, wherein a working treatment is applied on the filaments having passed through the gaseous media and been brought into contact with the preregeneration acid liquid medium.

* * * * *

UNITED STATES PATENT AND TRADEMARK OFFICE

CERTIFICATE OF CORRECTION

PATENT NO. : 4,126,656

DATED : November 21, 1978

INVENTOR(S) : Pierre Monzie et al

It is certified that error appears in the above-identified patent and that said Letters Patent are hereby corrected as shown below:

Column 2, line 40, delete the word "carring" and insert therefor -- carrying --.

Column 2, line 42, pluralize the word "viscose" to -- viscoses --.

Column 8, line 47, delete ";iquid" and insert -- liquid -- therefor.

Column 12, line 27, delete the comma after the word "significant".

Signed and Sealed this

*Third* Day of *April 1979*

[SEAL]

*Attest:*

RUTH C. MASON
*Attesting Officer*

DONALD W. BANNER
*Commissioner of Patents and Trademarks*